US005647449A

United States Patent [19]

Dennis

[11] Patent Number: 5,647,449

[45] Date of Patent: Jul. 15, 1997

[54] CROWNED SURFACE WITH PDC LAYER

[76] Inventor: Mahlon Dennis, 3726 Rocky Woods, Kingwood, Tex. 77339

[21] Appl. No.: 592,217

[22] Filed: Jan. 26, 1996

[51] Int. Cl.[6] ..... E21B 10/56

[52] U.S. Cl. ..... 175/434; 175/426; 76/108.2

[58] Field of Search ..... 175/420.1, 420.2, 175/426, 428, 431, 432, 434; 76/108.2

[56] References Cited

U.S. PATENT DOCUMENTS

| | | | |
|---|---|---|---|
| 4,109,737 | 8/1978 | Bovenkerk | 175/430 |
| 5,011,515 | 4/1991 | Frushour | 51/307 |
| 5,379,854 | 1/1995 | Dennis | 175/434 |
| 5,486,137 | 1/1996 | Flood et al. | 175/432 X |
| 5,499,688 | 3/1996 | Dennis | 175/434 X |
| 5,566,779 | 10/1996 | Dennis | 175/426 |

FOREIGN PATENT DOCUMENTS

| | | | |
|---|---|---|---|
| 2275068 | 8/1994 | United Kingdom | 175/434 |

*Primary Examiner*—David J. Bagnell

[57] ABSTRACT

The present disclosure is directed to a crowned insert. The insert is elongate, right cylinder, two ended body of carbide, preferably bonded tungsten carbide particles. The near end is sized to fit in a hole in a drill bit while the remote end is provided with an enlargement. The enlargement in one embodiment is provided with a circular profile, and has an edge which is chamfered with a radius of curvature to avoid sharp edges. The end of the insert is crowned with a PDC layer integrally cast and bonded thereto so that the enlargement is fully surrounded by the PDC crown.

20 Claims, 1 Drawing Sheet

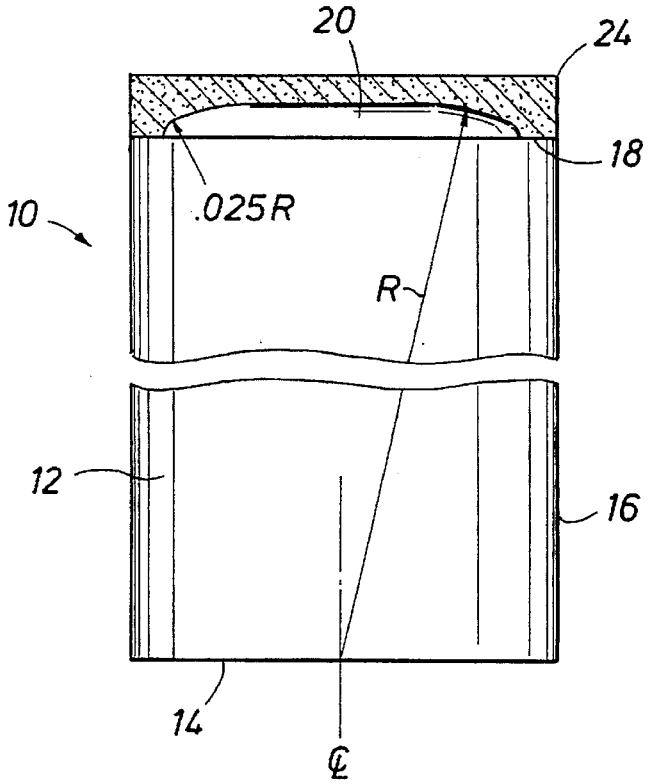
FIG. 1
FIG. 2
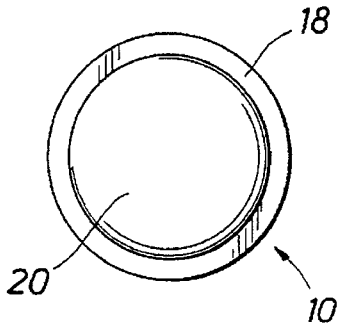
FIG. 3
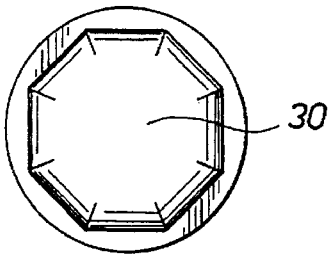
FIG. 4
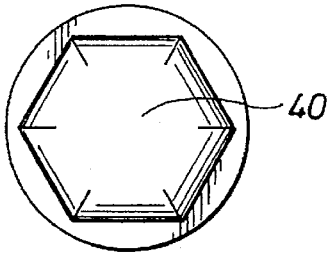
FIG. 5
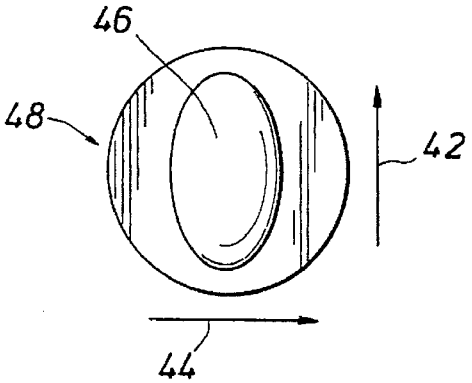
FIG. 6
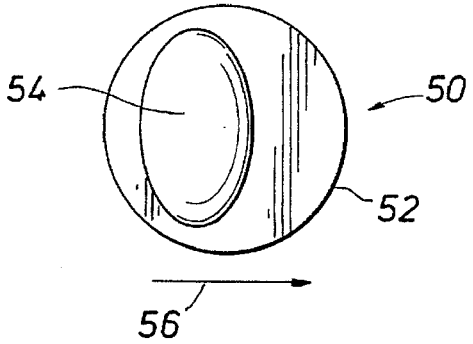

CROWNED SURFACE WITH PDC LAYER

BACKGROUND OF THE DISCLOSURE

The present disclosure is directed to an insert for use in drill bits, and especially to a drill bit insert featuring a crown on the insert capping the exposed end, and further incorporating a crown which is located under a PDC layer placed on the insert. The PDC layer is a layer of polycrystalline diamond which is shaped and contoured to a specified shape, and which forms a layer of very substantial hardness.

The insert of the present disclosure is fabricated of very hard metal, and is typically formed of various types of carbides. Among the harder carbide materials, the preferred form of insert construction is cobalt based tungsten carbide (WC) which provides a strong and vibration resistant body. It is hard, substantially as hard as any metal that can be fabricated. Moreover, the tungsten carbide insert is constructed so that it has a binding material in it to hold together tungsten carbide particles thereby yielding a composite material insert.

The outer end of the insert is crowned with a PDC layer. This refers to the layer of material which is crystalline in structure and which is formed of diamond material. It is a composite material with a binding agent mixed with small chips of crystalline nature. It is typically made from synthetic diamonds. These industrial grade diamonds are mixed small particles shaped in a mold so that the mold provides the desired shape to the finished product. If need be, the cap is molded in place on the insert. Further the small pieces of crystalline material are bonded together so that the whole of the structure has the form of a shock resistant cap on the end of the insert which is able to endure the rough conditions that occur during use of the drill bit having the insert installed in the bit body.

The insert of the present disclosure is formed as a right cylinder of circular cross section. The insert is elongate, having one end which is forced into a hole in the drill bit body. It is anchored in the bit body in an interference fit or by brazing to assure that it stays in the bit body. Thus anchored, the insert positions at a specified location the remote end which is contacted against formations making up the crust of the earth during drilling of an oil well. During drilling, the insert is jammed against the formation, and tends to either crush or gouge the facing materials while advancing a drilled hole. The remote end of the insert is exposed to scraping action against the formations of the earth and tends to be worn from scraping. As wear occurs, the wear grinds away the end portion. For that reason, the end is provided with the PDC cap. A representative prior art device is set forth in previously issued U.S. Pat. No. 4,109,737. This shows an insert installed in a drill bit body. The insert is provided with a crown formed of bonded diamond material on the end of the insert. More specifically, in FIG. 4a and also FIG. 4c of that disclosure, inserts are shown which extend over the exposed end face of the insert. The devices of the '737 patent are the prior art which has been used with some measure of success heretofore but which now represent the old way of doing things in the drill bit art. The insert of the present disclosure provides improvements over the referenced inserts of the '737 patent.

In one aspect, the present disclosure is drawn to and directs attention to a longer insert which is sufficiently long that it has an end which is exposed for drilling by striking on the wall surface in the well borehole. Whether the drilling action is described as chipping or gouging, the cutting action is accomplished by the long ended insert. The wear and tear of use is occasioned at the PDC crown. The crown in the present apparatus is protected from delamination which is a mode of failure which occurs when shear loading chips off a corner, thereby forming a break which may propagate across part or all of the PDC crown. The present disclosures sets forth a mechanism which overcomes that risk. Moreover, this disclosure describes a particular arrangement in which the PDC crown is shaped so that destruction does not occur in that fashion.

In one aspect of the present disclosure, a single protruding enlargement is integrally constructed in the unmodified insert, and this insert is then crowned or capped. This enables the enlargement to hold in place so that the PDC layer does not delaminate or otherwise fail in a catastrophic manner. Large scale failures are avoided by this approach. Large scale failures especially occur when the end layer is a substantially thick PDC layer which tends to be brittle, and which is not modified by the incorporation of or the inclusion of the necessary protective grasp between the WC insert body and the PDC crown attached to it.

SUMMARY OF THE INVENTION

Directing attention now to the present disclosure, it is summarized as an insert construction which has a WC body formed with an elongate right cylinder construction and defining an outer end having an upthrust or protrusion on it. In the preferred embodiment, the enlargement on the outer end of the insert is circular when viewed from above. In one embodiment, the enlargement on the end of the insert has a radius of curvature of about one inch or greater so that it gently curves, this being a common size enlargement for common size inserts. Indeed, it is quite successful for inserts which have a total height of about one quarter inch. The enlargement on the end face of the insert body is chamfered but is a chamfered surface which enables the PDC layer to fit smoothly with no sharp edges on the end of the insert.

The end of the insert is constructed with the preferred and requisite circular construction and that is the preferred form of the enlargement. In addition, oval or asymmetric shaped provide satisfactory results. The enlargement in addition to that is chamfered with a radius of curvature. A typical radius of curvature is about 0.025 R where R is the radius of curvature of the end face of the enlargement. The PDC layer is attached on top of that. In an alternate embodiment, the enlargement beneath the PDC layer is constructed with straight line sides such as 6 or 8 sides where they are in turn chamfered with the above-mentioned radius of curvature. Again, this avoids sharp corners of the insert which conforms against the PDC crown so that the crown is not exposed to stress concentrations in such sharp areas.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a side view of the insert of the present disclosure with a portion broken away and further showing the PDC layer in cross section and specifically detailing the radius of curvature of the enlargement on the end of the insert;

FIG. 2 is a plan view of the insert of FIG. 1 with the PDC layer omitted;

FIG. 3 is a plan view of an alternate embodiment;

FIG. 4 is a plan view of another alternate embodiment; and

FIGS. 5 and 6 are plan views of alternate embodiments having an oval enlargement.

DETAILED DESCRIPTION OF THE PREFERRED EMBODIMENT

Attention is first directed to FIG. 1 of the drawings in which a side view of the insert to the present disclosure is illustrated. More specifically, the finished product of this disclosure is generally identified by the numeral 10 and comprises an upstanding, right cylinder, east or molded body 12 which is an insert having a bottom face 14 and a side face 16. It is elongate and cylindrical. It has a top end face 18 and the face 18 centers around an end located enlargement 20 which will be discussed in detail below.

A typical insert of the present disclosure has a diameter of about 0.805 inches, and supports a concentric circular enlargement which is about 0.658 inches in width. The button shaped enlargement is constructed on the elongate right cylinder body which stands about 1.0 inches tall. The dimension R is shown in FIG. 1 and is the radius of curvature of the enlargement 20. The enlargement 20 is circular as illustrated, and the thickness of about 0.030 inches as the flat portion has a radius of curvature of R around the periphery and in this case R is preferably 1.000 inches. The enlargement 20 has a chamfered shoulder which is formed by shaping the enlargement button 20 fully around the periphery with a tapered shoulder or face defining a quarter round radius with a curvature of 0.025 R. This construction forms a button or enlargement sized so that the button has definitive slope and thereby defines the face 18 which is a concentric circular step fully around the enlargement 20. More specifically, the enlargement 20 is completely covered over by the PDC crown 24 which is cast in place on the enlargement 20. The crown 24 is thus cast to the same diameter as shown in FIG. 1 of the drawings. It is contacted against the step 18 which is the end face (surrounding the enlargement 20) and adheres to it to make a finished junction.

Going to FIG. 2 of the drawings, this shows the insert 10 with the PDC crown omitted. This shows the enlargement 20 on the end face 18. It again shows the circular construction of the insert. In this particular embodiment, the enlargement 20 is formed with a gently curving top or end face. Getting away from the marginal edge of the enlargement, it is, in sectional view, a slightly curving surface which has a rather long radius of curvature as represented by the symbol R shown in FIG. 1 of the drawings. In this particular embodiment, R is about one inch while the insert is about one inch in length. As will be understood, the radius of curvature can be more or less than the height of the insert. Whatever the case, the enlargement 20 has a particular radius of curvature, and this radius of curvature is constructed so that the enlargement body extends up into the crown which is cast in place. This provides a firm grip between the crown and the insert. This likewise provides a protrusion extending into the crown so that delamination does not occur by a horizontally propagated fracture plane. The edge of the enlargement 20 is curved or chamfered with the indicated radius or curvature of about 0.025 R. That assures that no sharp edges are formed, and none are required in the operation of the completed insert.

Going now to FIG. 2 of the drawings, it shows the circular enlargement in contrast with an eight sided enlargement 30 in FIG. 3 or a six sided enlargement 40 in FIG. 4. In both instances, the enlargement is chamfered in the same fashion as illustrated in FIG. 1 for the embodiment 10. The enlargements 30 and 40 however are chamfered in a different fashion. They are chamfered to the same radius of curvature but in this instance, both of the six and eight sided enlargements are provided with the illustrated foot print. So to speak, instead of being a circular button, they have the form of a regular, multiple sided polygon.

Something should be noted regarding the materials. The body of the insert is preferably formed of carbide which is cast in place with a binding agent such as cobalt powder and loose particles of the appropriate carbide. As noted, the preferred form is WC. The particles are screened so that suitable sizes are obtained. Moreover, the WC particles are cast to the desired cylindrical shape. Integrally cast with the insert 10 is also the enlargement 20 affixed to the end of the insert. The enlargement 20 thus forms a unitary structure. Furthermore, the enlargement 20 is so defined and so constructed that the enlargement 20 is provided with the top planar face and the surrounding circular side face which contacts against and bonds to the PDC which is cast in place to the desired shape on the exterior. This provides when completed the necessary structure.

Going both the FIGS. 5 and 6, the enlargement 46 in the embodiment 48 is a centered oval made with same sort of rounded periphery as shown in FIG. 1, and the oval can be made with the same height as shown in FIG. 1. The oval 46 can be oriented relative to the arrows 42 or 44 when the insert 48 is installed in a drill bit cone. The arrows show relative dragging movement during drilling. There are different types of formations and different abrasion rates and abrasion mechanisms dependent on the weight on the bit, fracture tendency of the formation and other aspects of the bit wear rate.

FIG. 6 shows the embodiment 50 with the enlargement 54 located off center, or made integrally so that the eccentered oval is near the edge first contacting the borehole during drilling. The arrow 56 shows the bit insert drag direction for the eccentered oval 54. The embodiment 50 is made with the same radius of curvature disclosed above. The drill bit insert 50 has a cylindrical outer face 52.

While the foregoing is directed to the preferred embodiment, the structure is determined by the claims which follow.

What is claimed is:

1. A drill bit insert for connection to a drill bit body having a hole therein to receive the insert wherein the insert comprises an elongate cylindrical insert body formed of a carbide material and having a multiple sided polygon enlargement on the end thereof, and further wherein said insert body incorporates an upstanding portion to support said enlargement at a spaced location from said bit body, a PDC crown over the end of said insert surrounding said enlargement wherein said crown and said enlargement have a bonded interface, and said enlargement is a closed geometric pattern on the end of said insert and is constructed with a rounded peripheral edge to thereby avoid sharp corners in said crown, and wherein said enlargement edge is devoid of sharp edges and has a radius of curvature.

2. The apparatus of claim 1 wherein said PDC crown comprises a monolithic cast or molded layer formed on a body of bonded tungsten carbide particles.

3. The apparatus of claim 1 wherein said enlargement has a central face with a radius of curvature and said enlargement is axially centered.

4. The apparatus of claim 1 wherein said PDC crown is formed of molded polycrystalline diamond compact material and said enlargement is circular and centered on said body; and said enlargement is constructed with said rounded peripheral edge at a curvature of 0.025 R where R is the radius of curvature of the end face of said enlargement.

5. The apparatus of claim 4 wherein said crown is integral and bonded to said body and said body and crown have a common cross sectional area.

6. The apparatus of claim 5 wherein said crown and enlargement, during use, wear without delamination of said crown.

7. The apparatus of claim 1 wherein said enlargement is a closed geometric pattern having a center, and said enlargement is eccentered.

8. A drill bit insert for connection to a drill bit body having a hole therein to receive the insert wherein the insert comprises an elongate cylindrical insert body formed of a carbide material and having an enlargement on the end thereof, and further wherein said insert body incorporates an upstanding portion to support said enlargement at a spaced location from said bit body, a PDC crown over the end of said insert surrounding said enlargement wherein said crown and said enlargement have a bonded interface and wherein said PDC crown is formed of molded polycrystalline diamond compact material and said enlargement is circular and centered on said body; and said enlargement is a closed geometric pattern on the end of said insert and is constructed with a rounded peripheral edge to thereby avoid sharp corners in said crown, and wherein said enlargement edge is devoid of sharp edges and has a radius of curvature of 0.025 R where R is the radius of curvature of the end face of said enlargement.

9. The apparatus of claim 8 wherein said PDC crown comprises a monolithic cast or molded layer.

10. The insert of claim 8 wherein said enlargement is an axially centered multiple sided polygon.

11. The apparatus of claim 8 wherein said insert body is formed of bonded tungsten carbide particles.

12. The apparatus of claim 8 wherein said crown is integral and bonded to said body and said body and crown have a common cross sectional area.

13. The apparatus of claim 12 wherein said crown and enlargement, during use, wear without delamination or said crown.

14. The apparatus of claim 8 wherein said enlargement has a center, and said enlargement is eccentered.

15. A drill bit insert for connection to a drill bit body having a hole therein to receive the insert wherein the insert comprises an elongate oval cylindrical insert body formed of a carbide material and having an enlargement on the end thereof, and further wherein said insert body incorporates an upstanding portion to support said enlargement at a spaced location from said bit body, a PDC crown over the end of said insert surrounding said enlargement wherein said crown and said enlargement have a bonded interface, and said enlargement is a closed geometric pattern on the end of said insert and is constructed with a rounded peripheral edge to thereby avoid sharp corners in said crown, and wherein said enlargement edge is devoid of sharp edges and has a radius of curvature.

16. The apparatus of claim 15 wherein said PDC crown comprises a monolithic cast or molded layer and said body is formed of bonded tunsten carbide particles.

17. The apparatus of claim 15 wherein said enlargement is circular and wherein said enlargement has a central face with a radius of curvature.

18. The apparatus of claim 15 wherein said oval is centered on said insert body.

19. The apparatus of claim 15 wherein said oval is aligned on said insert at right angles to said insert draft during drilling.

20. The apparatus of claim 15 wherein said oval is aligned on said insert parallel to said insert draft during drilling.

* * * * *